US009670045B2

(12) United States Patent
Riggio

(10) Patent No.: US 9,670,045 B2
(45) Date of Patent: Jun. 6, 2017

(54) MACHINE FOR FILLING CONTAINERS BY WEIGHING

(71) Applicant: SMI S.p.A., Bergamo (IT)

(72) Inventor: Antonio Riggio, Bergamo (IT)

(73) Assignee: SMI S.p.A., Bergamo (IT)

( * ) Notice: Subject to any disclaimer, the term of this patent is extended or adjusted under 35 U.S.C. 154(b) by 0 days.

(21) Appl. No.: 14/807,471

(22) Filed: Jul. 23, 2015

(65) Prior Publication Data

US 2016/0090287 A1 Mar. 31, 2016

(30) Foreign Application Priority Data

Sep. 26, 2014 (IT) ..... MI2014A1681

(51) Int. Cl.

| | |
|---|---|
| ***B65B 1/04*** | (2006.01) |
| ***B67C 3/20*** | (2006.01) |
| ***B67C 3/22*** | (2006.01) |
| ***B67C 3/24*** | (2006.01) |

(52) U.S. Cl.
CPC ..... *B67C 3/202* (2013.01); *B67C 3/225* (2013.01); *B67C 3/24* (2013.01)

(58) Field of Classification Search
CPC B67C 3/242; B67C 3/202; B65B 3/28; B65B 1/32
See application file for complete search history.

(56) References Cited

U.S. PATENT DOCUMENTS 6,073,667 A * 6/2000 Graffin ..... B67C 3/202 141/372
2012/0012224 A1* 1/2012 Haeuslmann ..... B67C 3/202 141/1

FOREIGN PATENT DOCUMENTS

EP 0 001 196 3/1979

* cited by examiner

*Primary Examiner* — Jason K Niesz
(74) *Attorney, Agent, or Firm* — Merchant & Gould P.C.

(57) ABSTRACT

The present invention relates to a machine for filling containers, in particular bottles or the like with a product, particularly a liquid such as a drink, by means of a weighing system.

8 Claims, 2 Drawing Sheets

MACHINE FOR FILLING CONTAINERS BY WEIGHING

BACKGROUND OF THE INVENTION

The present invention relates to a machine for filling containers, in particular bottles or the like, with a product particularly a liquid such as a drink, by means of a weighing system.

There are various types of machine for filling containers, in particular bottles or the like with a liquid. These machines include a transport system, which may be circular (distribution carousel or wheel) or linear (conveyor belt), on which the bottle is made to transit. Above the neck of the bottle a filling valve is placed which delivers the filling liquid taken from a special tank.

To prevent overfilling of the bottle, systems are designed which automatically detect the level of liquid in said bottle and interrupt the flow of liquid dispensed. Typically, the interruption signal is sent to a driving and control unit which then closes the filling valve.

These automatic detection systems are of various kinds. For example, some of them provide for reading the filling level using photoelectric cells or suitable viewing systems (i.e. cameras). Others provide for the introduction of a suitable sensor through the neck of the bottle to detect the filling level and send the interruption signal to the driving and control unit.

One system that has proved effective and of limited cost, provides for weighing the container and interrupting filling at a predetermined weight. This system also has limited overall dimensions, since it can be integrated into the bottle support members.

If the bottle is in a heavy material such as glass, it can easily be supported by a special plate placed along the periphery of a carousel or a wheel transport system. Below the plate a weighing system is positioned which detects the weight of the bottle and, when reaching the predetermined weight, sends an interruption signal to the driving and control unit of the machine, which in turn cuts off the flow of liquid by closing the filling valve.

This system must be calibrated according to the container to be filled and the filling liquid, but is in itself efficient and profitable.

When the bottle is in a lightweight material such as plastic, the plate support system can no longer be used because the bottle would not have the necessary stability. In these cases therefore the bottle is moved keeping it suspended by the neck using suitable clamps which are positioned at the collar ring. This means that regardless of the size of the bottle, the neck with the collar ring always has the same shape, a feature that allows a substantial mechanical simplification of the machine.

SUMMARY OF THE INVENTION

The problem addressed by this invention is to provide a device for filling containers, in particular lightweight plastic bottles, with a liquid by means of a weight filling system.

Such problem is solved by a filling device as outlined in the appended claims, the definitions of which form an integral part of the present description.

BRIEF DESCRIPTION OF THE DRAWINGS

Further characteristics and advantages of the present invention will, in any case, be more clearly comprehensible from the description given below of some embodiments, made by way of a non-limiting example with reference to the appended drawings.

DETAILED DESCRIPTION OF THE PREFERRED EMBODIMENTS

Figure 1:
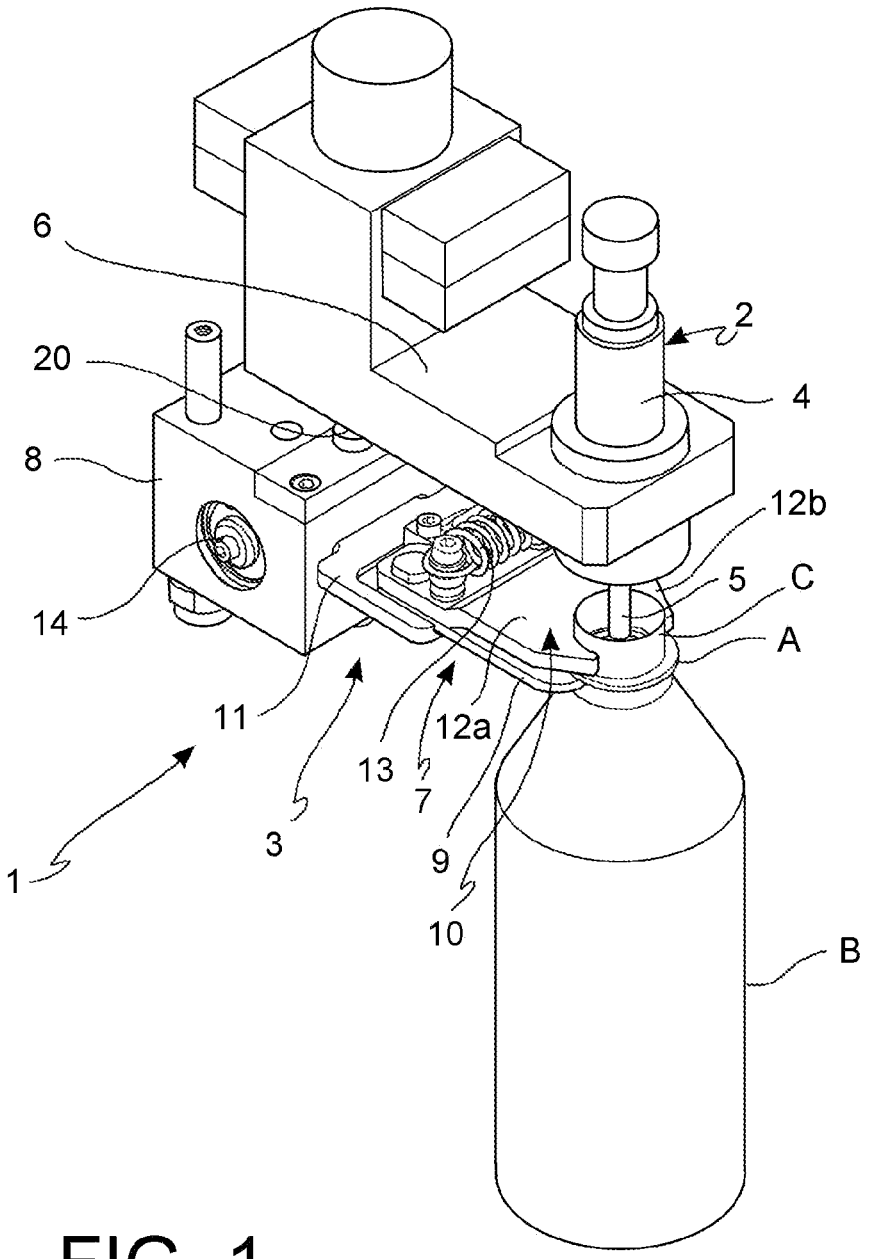
FIG. 1 is a perspective view of the filling device of the invention.
Figure 2:
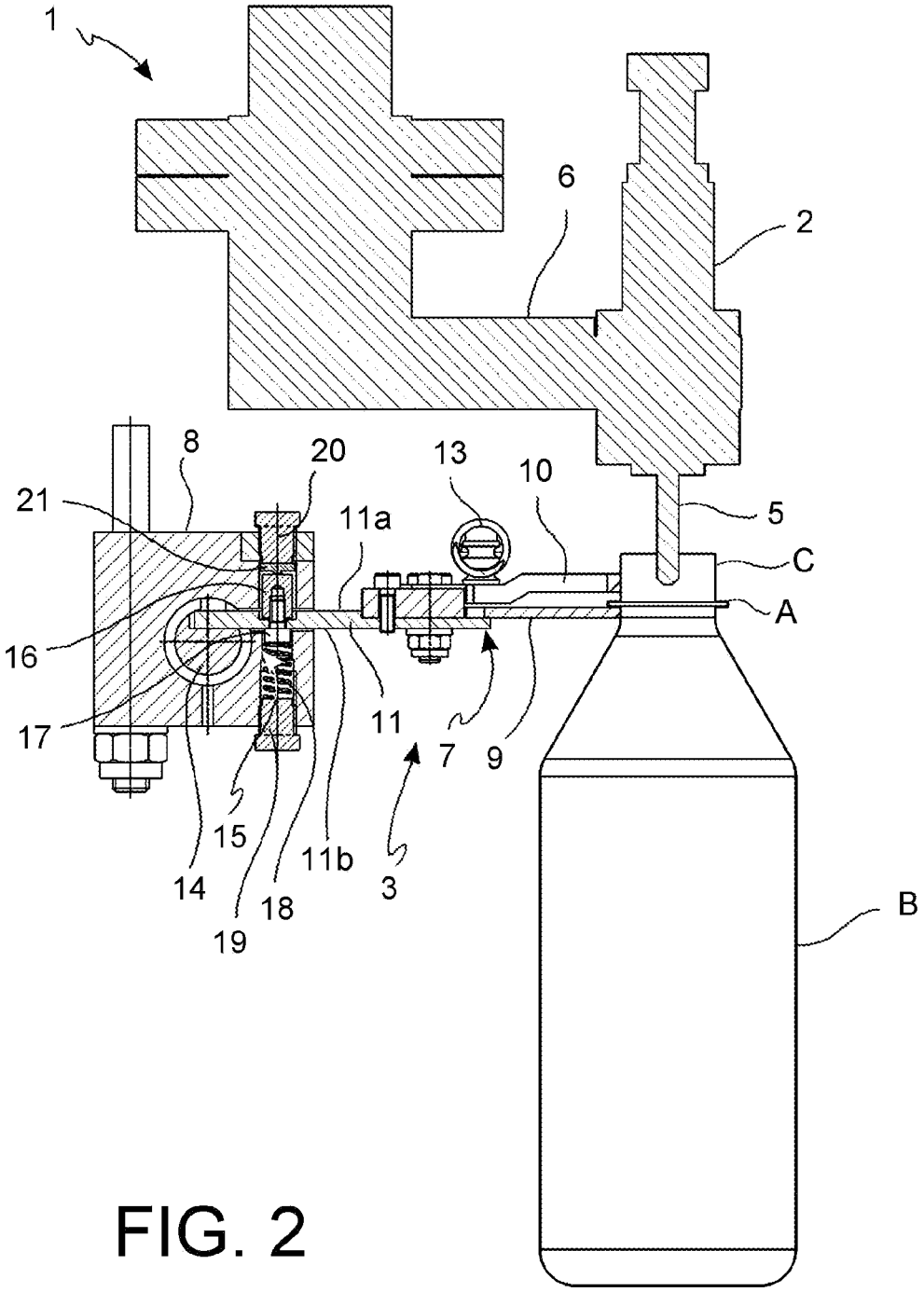
FIG. 2 is a side view in cross-section of the filling device in FIG. 1.

With reference to the drawings, reference numeral 1 globally denotes the filling device of a container according to the invention. The container is typically a bottle B, in particular a bottle in a lightweight material such as PET (polyethylene terephthalate).

The filling device 1 comprises a filling valve 2 and a support member 3 of the bottle B.

The filling valve 2 is a filling valve of the conventional type, which will not be described in detail. The filling valve 2 comprises a valve body 4 inside which a suitable shutter (not shown) is placed for the opening/closing of the flow of filling liquid, and is connected to a tank of filling liquid by means of appropriate pipes (not shown). Under the valve body a spout 5 is placed for dispensing the liquid. The filling valve 2 may also comprise a dispensing system of a sterile gaseous fluid, for example sterile air, around the nozzle 5 and/or the filling device 1 itself may be inserted in a confined environment in which a sterile gaseous fluid is made to circulate. This type of set-up is particularly used when the filling liquid is a beverage or a liquid medicine.

The filling valve 2 is supported on an arm 6 which in turn is secured to the structure of a linear or rotary machine (not shown) for moving the bottles. The rotary machine typically comprises a carousel and/or a distribution wheel. The linear machine typically comprises a conveyor belt.

The support member 3 of the bottle B comprises a fork arm 7 supported so as to tilt on a joining body 8 in turn attached to the structure of said rotary or linear machine, so as to move integrally with it and the filling valve 2.

The fork arm 7 comprises a tilting plate 11 which is inserted in the joining body 8 and protrudes from it. A fork 9 and, above it, a clamp 10 are jointed to the outer end of the tilting plate 11.

The fork 9 is arranged so as to support the bottle B by the collar ring A, while the clamp 10 couples the neck C of the bottle B above the collar ring A.

The clamp 10 is composed of two jaws 12*a*, 12*b* which are hinged on the tilting plate 11 and can be opened in opposition with a spring 13 by means of a conventional mechanism.

The opposite end of the tilting plate 11, i.e. the end inserted in the joining body 8, is attached to a hinge which allows the tilting of the plate 11 upwards or downwards, respectively towards or away from the spout 5 of the filling valve 2. As is evident from the description below, the amount of tilting is minimal, so in different embodiments the tilting capacity of the plate 11 could be entrusted solely to the elasticity of the material used, without therefore providing the hinge 14, but attaching the inner end of the tilting plate 11 to the joining body 8. However, the embodiment which provides for the hinge 14 is preferred.

The joining body 8 comprises a vertical through hole 15 which intercepts the tilting plate 11. On the upper surface 11*a* of the tilting plate 11, at the vertical hole 15, a pusher element 16 is attached which thus fits in the upper portion of the vertical hole 15. The pusher element 16 is attached by means of a screw 17 inserted from below and the head of which protrudes from the underside 11*b* of the tilting plate 11, at the lower portion of the vertical hole 15.

The head of the screw 17 constitutes a contrast surface with a spring 18, typically a coil spring, inserted in the lower portion of the vertical hole 15 of the joining body 8. The spring 18 is kept in place by an adjustable member 19, for example, an adjustment screw, which closes the lower opening of the vertical hole 15 and permits modification of the preload of the spring 18.

In the upper portion of the vertical hole 15 a load detection member 20 is inserted, which comprises on its lower surface, facing the pusher element 16 of the tilting plate 11, a sensor 21, such as a load cell. The sensor 21 is of the conventional type and is operatively connected, e.g. by appropriate wiring (not shown) or with a wireless system, to a driving and control unit (not shown) which controls the opening and closing of the filling valve 2.

The weighing system 1 works as follows: When a bottle B is taken by the fork arm 7 and is then moved by the transport system of the linear or rotary machine, the driving and control unit orders the opening of the filling valve 2 and begins to dispense the liquid which starts to fills the bottle B. As with a conventional filling machine, the filling starts when the device reaches a predetermined and adjustable phase angle in the case of a device mounted on a carousel, and a predetermined and adjustable phase position in the case of a device mounted on a linear system. Said commencement of filling can be inhibited in the case of no bottle being present, as detected by an appropriate detection system (not shown because of the conventional type and since irrelevant for the purposes of this description).

The preloaded spring 18 pushes the pusher element 16 of the tilting plate 11 against the sensor 21 with a precalibrated force. As filling progresses, the weight of the bottle counters the thrust of the spring 18, so that the pressure of the pusher element against the sensor 21 decreases. When this pressure reaches a predetermined threshold level, the driving and control unit sends a command to close the filling valve 2 which then stops dispensing of the liquid. Interruption of the filling is thus achieved following a negative reading of the weight of the bottle B.

Substantially, the detecting member 20 detects the weight of the bottle B in negative as the difference between a predetermined initial load and an end load less than said initial load, said end load being in turn predetermined as a function of the filling level of the bottle.

The advantages of the invention are evident.

The device according to the invention is adaptable to state of the art filling machines, replacing the support bracket of the bottle with the support member 3 according to the invention.

The dimensions of the device according to the invention are limited, being integrated in the support bracket of the bottle. There are no external sensors or cameras.

The device according to the invention is constructionally simple and of limited cost.

It is clear that only some particular embodiments of the present invention have been described, which the person skilled in the art may modify so as to adapt it for specific applications while remaining within the sphere of protection of the present invention.

The invention claimed is:

1. A device for filling a bottle made of a light-weight material, comprising:

a filling valve and a support member of the bottle, the support member of the bottle comprising a detecting member detecting a weight of the bottle, wherein the detecting member detects the weight of the bottle in negative as a difference between a predetermined initial load and an end load less than said initial load, said end load being predetermined as a function of a desired filling level of the bottle.

2. The device for filling containers according to claim 1, wherein the support member of the bottle comprises a fork arm supported in a tilting manner on a joining body with a rotary or linear machine for handling containers, the fork arm comprising a tilting plate which is inserted in the joining body and projects from the joining body, wherein an end of the tilting plate inserted in the joining body is secured to a hinge allowing the plate to tilt upwards or downwards in opposition to a preloaded spring to apply, under a rest condition, a predetermined load onto said detecting member.

3. The device according to claim 2, wherein the joining body comprises a vertical through hole intercepting the tilting plate, on the upper surface of the tilting plate, a pusher member being secured at the vertical through hole, which inserts in the upper portion of the vertical through hole, the pusher member being secured by a screw which is inserted from the bottom and the head of which protrudes from a lower surface of the tilting plate, at a lower portion of the vertical hole, so as to form an opposite surface with said spring.

4. The device according to claim 3, wherein the spring is kept in place by an adjustable screw, which closes the lower opening of the vertical hole and allows modification of the preload of the spring.

5. The device according to claim 2, wherein the detecting member comprises in a lower surface thereof, a sensor, said sensor being operatively connected to a driving and control unit which drives the opening/closing of the filling valve.

6. The device according to claim 5, wherein said driving and control unit drives closing of the filling valve and stops dispensing of filling liquid when the detecting member sends a signal corresponding to said predetermined end load being reached.

7. The device according to claim 2, wherein the filling valve comprises a valve body within which a shutter for opening/closing flow of filling liquid is arranged, and which is connected to a filling liquid reservoir by a pipe, under the valve body a sprout being arranged for dispensing the liquid, the filling valve being supported on an arm which is secured to structure of said rotary or linear machine for handling containers.

8. A rotary or linear machine for handling containers, comprising a plurality of devices according to claim 1 for filling containers with a beverage.

* * * * *